US009908686B2

(12) United States Patent
Wang et al.

(10) Patent No.: US 9,908,686 B2
(45) Date of Patent: Mar. 6, 2018

(54) PILL DISPENSER AND SYSTEM

(71) Applicant: Ameizen LLC, New York, NY (US)

(72) Inventors: Qiongyi Wang, New York, NY (US); Ian White, Philadelphia, PA (US); Joseph Jackson, Wilmington, DE (US); Ian McDermott, Lincoln University, PA (US)

(73) Assignee: AMEIZEN LLC, New York, NY (US)

( * ) Notice: Subject to any disclaimer, the term of this patent is extended or adjusted under 35 U.S.C. 154(b) by 50 days.

(21) Appl. No.: 14/321,115

(22) Filed: Jul. 1, 2014

(65) Prior Publication Data

US 2016/0001955 A1 Jan. 7, 2016

(51) Int. Cl.

| | |
|---|---|
| ***B65H 3/00*** | (2006.01) |
| ***B65D 83/04*** | (2006.01) |
| *G07F 11/54* | (2006.01) |
| *G07F 11/56* | (2006.01) |

(52) U.S. Cl.

CPC ..... *B65D 83/0409* (2013.01); *G07F 11/54* (2013.01); *G07F 11/56* (2013.01)

(58) Field of Classification Search

CPC ..... G07F 11/54; G07F 11/56; B65D 83/0409
USPC ..... 221/186, 265, 15, 68, 154, 203, 287
See application file for complete search history.

(56) References Cited

U.S. PATENT DOCUMENTS 2,176,232 A * 10/1939 Warren ..... A47F 1/10 221/265
2,211,452 A * 8/1940 Bowman ..... A47F 1/035 222/429
2,630,245 A * 3/1953 Maier ..... A47F 1/03 221/264
2,750,072 A * 6/1956 Duncan ..... G01F 11/24 222/181.2
2,756,901 A 7/1956 Cowsert et al.
2,880,906 A 4/1959 Probasco
2,960,259 A 11/1960 Aveni et al.
3,128,011 A * 4/1964 Bleiman ..... G07F 11/44 221/154
3,246,806 A * 4/1966 McBride, Jr. ..... A01C 9/08 221/265
3,515,111 A * 6/1970 Auge ..... A63F 9/0252 124/16
3,785,525 A * 1/1974 Handeland ..... B65G 47/1471 221/15
3,885,703 A 5/1975 Neavin
4,460,106 A 7/1984 Moulding et al.
(Continued)

FOREIGN PATENT DOCUMENTS

EP 0078126 B1 9/1985
EP 1074236 A2 * 2/2001 ..... A61F 15/001
(Continued)

*Primary Examiner* — Rakesh Kumar
(74) *Attorney, Agent, or Firm* — Renner, Otto, Boisselle & Sklar, LLP.

(57) ABSTRACT

Pill dispensers including a housing, a bottom cap that engages an open bottom end of the housing, and a base that engages the bottom cap such that the bottom cap is spaced from the base. The bottom cap is adapted to facilitate movement of pills into a transport member, which is moveable with respect to the remainder of the bottom cap from a first position aligned with an upper opening in the bottom cap to a second position aligned with a lower opening in the bottom cap, through which a pill is dispensed.

20 Claims, 9 Drawing Sheets

(56) References Cited

U.S. PATENT DOCUMENTS 4,523,694 A 6/1985 Veltri
4,530,447 A * 7/1985 Greenspan ..... B65D 83/04 221/288
5,097,985 A * 3/1992 Jones ..... A63B 47/002 124/48
5,259,531 A 11/1993 Bennett
5,269,432 A 12/1993 Beckertgis
5,484,089 A 1/1996 Picerno
5,520,307 A 5/1996 Miller et al.
5,702,029 A * 12/1997 Yang ..... G07F 13/10 221/221
5,785,206 A * 7/1998 Chan ..... G07F 11/14 221/198
5,791,515 A 8/1998 Khan et al.
5,853,115 A 12/1998 Turbett et al.
6,119,894 A 9/2000 Hassan
7,240,795 B2 7/2007 Lee
7,377,401 B2 5/2008 Humphrey
7,404,500 B2 * 7/2008 Marteau ..... B65D 83/0409 221/154
7,445,169 B2 11/2008 Young et al.
7,735,684 B2 6/2010 Coe et al.
8,746,225 B2 * 6/2014 Christopher ..... F41B 11/53 124/51.1
9,010,585 B1 * 4/2015 Schultz ..... B65G 11/186 222/132
2006/0091147 A1 * 5/2006 Arndt ..... G07F 11/16 221/208
2007/0007301 A1 1/2007 Kaplan et al.
2015/0027286 A1 * 1/2015 Yuyama ..... G07F 11/66 83/105
2016/0001955 A1 * 1/2016 Wang ..... B65D 83/0409 221/268

FOREIGN PATENT DOCUMENTS

EP 1551738 B1 12/2012
EP 1842797 B1 7/2013

* cited by examiner

PILL DISPENSER AND SYSTEM

FIELD OF THE INVENTION

The present invention relates generally to devices for dispensing pills and the like, and more particularly to devices that dispense pills one at a time.

BACKGROUND OF THE INVENTION

Every day, millions of people endure the laborious procedure of prying or twisting off a pill bottle cap, turning the bottle upside down, dumping too few or too many pills in their hand, repeating the procedure or returning extras to the bottle, and finally putting the cap back on. This process can be particularly difficult and painful for those with arthritic conditions or other motor difficulties. In addition, the numerous pills and tablets that people often take at one time may have varying sizes and shapes. This makes the process of manually dispensing pills from bottles even more cumbersome. Furthermore, the burdensome pill taking process tends to hinder people's behaviors and habit forming to take pills regularly based on the dosing instructions, causing low compliance and leading to various types of negative consequences due to not following the pill taking instructions.

The present invention provides an improved pill dispenser and pill dispenser system.

BRIEF SUMMARY OF THE INVENTION

According to an aspect of the invention, a pill dispenser adapted to dispense pills includes a housing having a top end and an open bottom end and a bottom cap adapted to engage the open bottom end of the housing. The bottom cap includes an upper bottom surface having an upper opening sufficiently large to receive a pill such that a pill may traverse the upper bottom surface, a ramp adapted to direct pills toward the upper opening, a lower bottom surface spaced from the upper bottom surface by a distance greater than a height or width dimension of the pill. The lower bottom surface has a lower opening that is sufficiently large to receive a pill and is not vertically aligned with the upper opening. The pill dispenser further includes a transport member having a pill receiving portion that is moveable with respect to the remainder of the bottom cap from a first pill position aligned with the upper opening to a second pill position aligned with the lower opening.

According to an aspect of the invention, the transport member may be rotatable with respect to the remainder of the bottom cap.

According to an aspect of the invention, the pill dispenser may also include a biasing member adapted to bias the transport member toward the first position.

According to an aspect of the invention, the transport member may include a tab extending outwardly from a side of the bottom cap, wherein movement of the tab from a first tab position to a second tab position causes movement of the pill receiving portion from the first pill position to the second pill position.

According to an aspect of the invention, the tab may be biased toward the first tab position.

According to an aspect of the invention, the pill dispenser may further include a sweeper above the ramp.

According to an aspect of the invention, the sweeper may have a length that is greater than a difference in length between a radius of the housing and the diameter of a pill.

According to an aspect of the invention, movement of the transport member may cause movement of the sweeper.

According to an aspect of the invention, the transport member and the sweeper may be both rotatable with respect to the remainder of the bottom cap, and rotation of the transport member with respect the remainder of the bottom cap may cause rotation of the sweeper with respect to the remainder of the bottom cap such that the transport member and the sweeper have the same amount of rotation.

According to an aspect of the invention, the lower bottom surface may be spaced from an end of the upper bottom opening by a distance of greater than the height dimension of the pill and less than one and one half times the height dimension of the pill.

According to an aspect of the invention, the pill dispenser may further include a stand having a base and a top portion that engages the bottom cap such that the bottom cap is spaced from the base.

According to an aspect of the invention, the base may be adapted to engage an adjacent base of an adjacent stand.

According to an aspect of the invention, the base may be slidably engageable with an adjacent base.

According to an aspect of the invention, the pill dispenser may further include a second pill dispenser, wherein the pill dispenser and the second pill dispenser are engaged.

According to an aspect of the invention, the base may include a recess under the bottom cap.

According to an aspect of the invention, the pill dispenser may further include a pill container for storing multiple pills, wherein the pill container is adapted to be positioned on the base under the bottom cap.

According to an aspect of the invention, the pill container may be positioned on the base under the bottom cap, the relative position of the pill container with respect to the bottom cap is maintained by a recess in the base.

According to an aspect of the invention, the pill container may include a pill container housing having an open top end and a closed bottom end, a top cap adapted to engage the open top end of the pill container housing, and a closable opening through which pills can be dispensed.

According to an aspect of the invention, a top end of the pill container may be adapted to engage with a bottom end of another container.

According to an aspect of the invention, a system for dispensing and storing pills includes a first pill dispenser and a second pill dispenser. Each of the first and second pill dispensers includes: a housing having a top end and an open bottom end, a bottom cap adapted to engage the open bottom end of the housing, the bottom cap having a closable opening through which pills can be dispensed, and a stand having a base and a top portion that engages the bottom cap such that the bottom cap is spaced from the base, wherein the base is engageable with a base of an adjacent pill dispenser. The system further includes a first pill container and a second pill container, where each of the first and second pill containers adapted to be positioned on a base of a pill dispenser. Each of the first and second pill containers includes a pill container housing having an open top end and a closed bottom end and a top cap adapted to engage the open top end of the pill container housing. The bottom end of the first pill container may be engageable with the top end of the second pill container.

With reference to the following description and drawings, the particular embodiments of the present disclosure are disclosed in detail, and the principle of the present disclosure and the manners of use are indicated. It should be understood that the scope of the embodiments of the present disclosure is not limited thereto. The embodiments of the present disclosure contain many alternations, modifications and equivalents within the spirits and scope of the terms of the appended claims.

Features that are described and/or illustrated with respect to one embodiment may be used in the same way or in a similar way in one or more other embodiments and/or in combination with or instead of the features of the other embodiments.

It should be emphasized that the term "includes/including" when used in this specification is taken to specify the presence of stated features or components but does not preclude the presence or addition of one or more other features, components or groups thereof.

Many aspects of the invention can be better understood with reference to the following drawings. The components in the drawings are not necessarily to scale, emphasis instead being placed upon clearly illustrating the principles of the present disclosure. To facilitate illustrating and describing some parts of the invention, corresponding portions of the drawings may be exaggerated in size, e.g., made larger in relation to other parts than in an exemplary device actually made according to the invention. Elements and features depicted in one drawing or embodiment of the invention may be combined with elements and features depicted in one or more additional drawings or embodiments. Moreover, in the drawings, like reference numerals designate corresponding parts throughout the several views and may be used to designate like or similar parts in more than one embodiment.

DETAILED DESCRIPTION OF THE INVENTION

The invention relates to novel pill dispensers adapted to dispense pills, and novel pill dispenser systems. The pill dispenser includes a housing having a top end and an open bottom end and a bottom cap adapted to engage the open bottom end of the housing. The bottom cap has an upper bottom surface having an upper opening sufficiently large to receive a pill positioned between the center of the bottom surface and an edge of the bottom cap. The bottom cap also includes a ramp adapted to direct pills toward the upper opening and a lower bottom surface spaced from the upper bottom surface. The lower bottom surface has a lower opening sufficiently large to receive a pill and is not vertically aligned with the upper opening. Between the upper bottom surface and the lower bottom surface is a transport member that is adapted to move a pill from the upper opening to the lower opening. The pill dispenser thus facilitates dispensing a single pill at a time.

Figure 1:
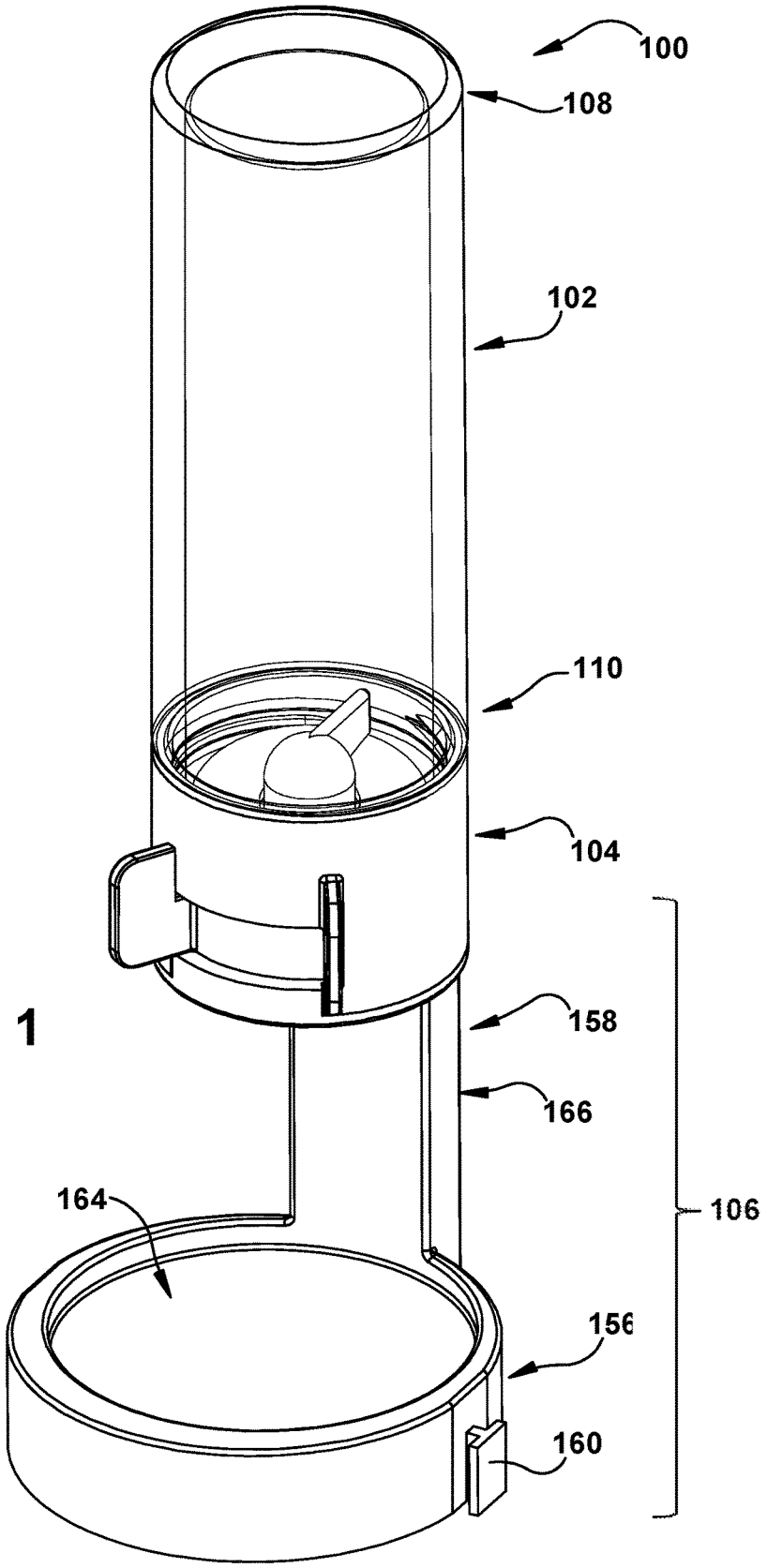
FIG. 1 is a perspective view of a pill dispenser.

Turning initially to FIG. 1 perspective and bottom views of a pill dispenser 100 are provided. The pill dispenser 100 includes a housing 102, a bottom cap 104 and a stand 106. The housing 102 includes a top end 108 and an open bottom end 110. The housing 102 is adapted to house pills, which preferably have uniform size and shape. As shown, the housing 102 and bottom cap 104 each has a cylindrical shape with a circular cross section, but the housing 102 and/or the bottom cap 104 could instead have a cross section that is non-circular.

The top end 108 is closed in the embodiment illustrated, but the top end 108 could alternatively include a closable opening through which pills may be inserted into the housing 102. The bottom end 110 may have an opening that forms substantially the entirety of the bottom end 110 of the housing as shown, or the bottom end 110 may have an opening that forms only a portion of the bottom end 110. The bottom end 110 is adapted to engage, preferably removably engage, the bottom cap 104. In one embodiment, the bottom opening is threaded, but those of skill in the art will recognize that the bottom end 110 and the bottom cap 104 may be slidably engageable, rotatably engageable and/or snapably engageable by employing any number of well-known engagement mechanisms. The bottom cap 104 likewise is adapted to engage the housing 102. In one embodiment, there is a gasket, such as a rubber gasket, between the housing 102 and the bottom cap 104. In another embodiment, the bottom cap 104 and the housing 102 are permanently engaged.

Turning next to FIGS. 2A-E, various views of the bottom cap 104 are provided. The bottom cap 104 includes an upper bottom surface 112. The upper bottom surface 112 includes an upper opening 114, which is sufficiently large to receive a pill such that a pill may traverse the upper bottom surface 112. Preferably, the opening 114 is not large enough to accommodate more than one pill at a time. Between the center 116 of the bottom cap 104 and the edge 118 of the bottom cap is a ramp 120 that is adapted to direct pills toward the upper opening 114. As noted above, the pills are preferably spherical in shape so as to facilitate movement toward the opening 114. In addition, the bottom cap 104 includes threads 122 for engaging threads of the bottom end 110 of the housing 102.

Figure 2A:
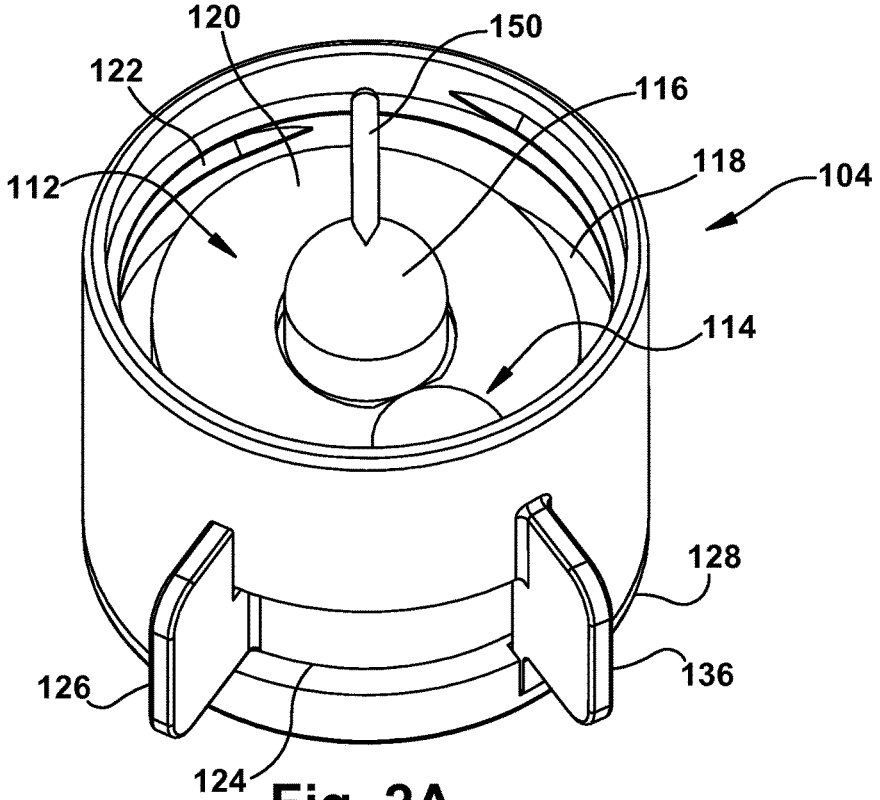
FIG. 2A is a perspective view of the bottom cap of the pill dispenser of FIG. 1.
Figure 2B:
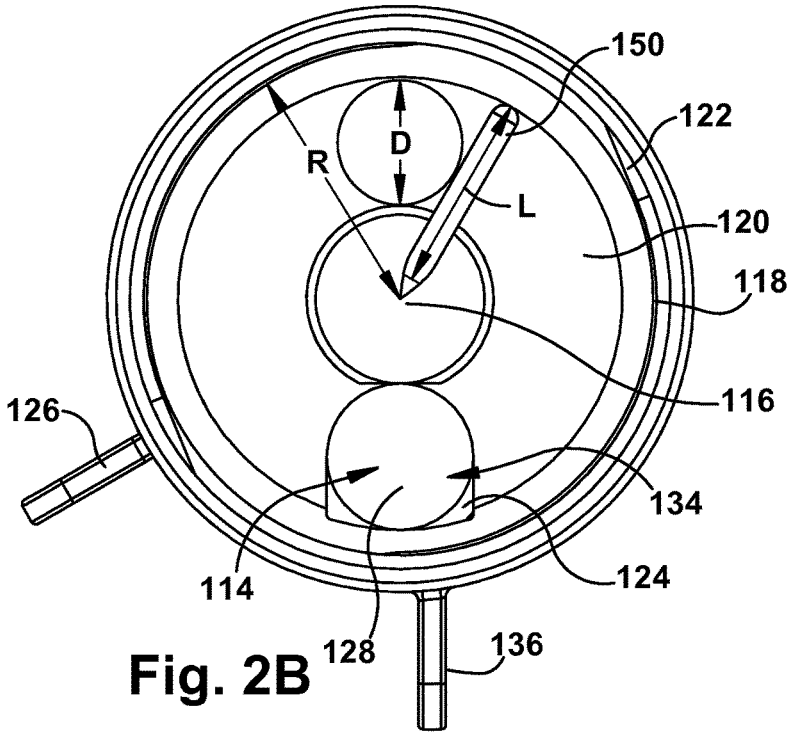
FIG. 2B is a top view of the bottom cap of the pill dispenser of FIG. 1.
Figure 2C:
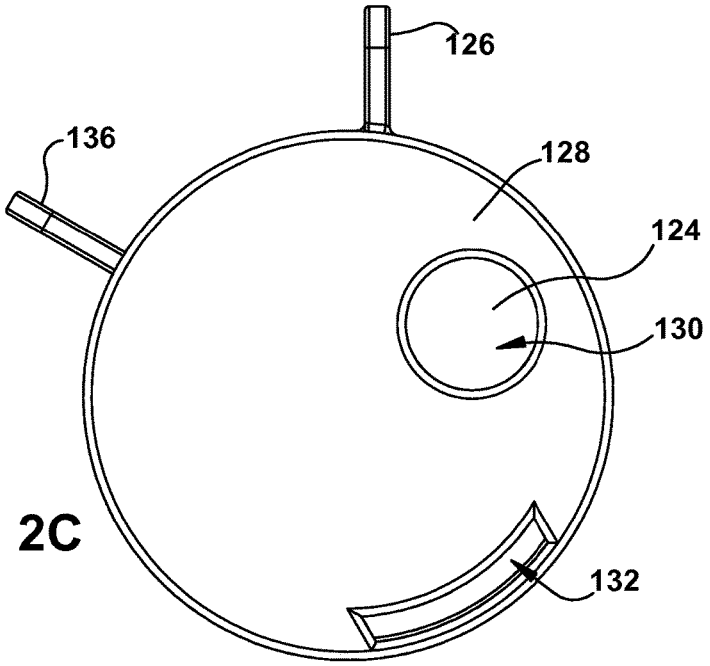
FIG. 2C is a bottom view of the bottom cap of the pill dispenser of FIG. 1.

The bottom cap also includes a lower bottom surface 128 having a lower opening 130 sufficiently large to receive a pill. The lower bottom opening 130 and the upper bottom opening 114 are not vertically aligned so that when a pill traverses the upper bottom opening 114, it will not also immediately traverse the lower bottom opening 124. In one embodiment, once a pill traverses the upper bottom opening, its vertical motion will be stopped by the lower bottom surface 128. The lower bottom surface 128 may also be adapted to engage the stand 106. As shown in FIG. 2C, the lower bottom surface 128 includes a slot 132 for receiving an upper portion of the stand 106.

The bottom cap 104 further includes a transport member 124 positioned to receive a pill at a pill receiving portion 134 after the pill traverses the upper bottom surface 112 via the opening 114. The transport member 124 includes a tab 126 for facilitating user directed movement of the transport member 124 with respect to the remainder of the bottom cap 104. The bottom cap 104 further includes an additional immovable tab 136. Thus, a user may move the transport member 124 with respect to the remainder of the bottom cap 104 by moving tab 126 toward tab 136. In the presently preferred embodiment tabs 126 and 136 may be "pinched" together to cause movement the transport member 124 with respect to the remainder of the bottom cap 104. More specifically, pinching the tabs 126 and 136 together causes rotation of the transport member 124 with respect to the remainder of the bottom cap 104. Thus, in the embodiment illustrated, the transport member 124 is rotatable with respect to the remainder of the bottom cap 104. It should be understood by those of skill in the art that while tabs are illustrated and discussed herein, any mechanism for moving the transport member 124 with respect to the remainder of the bottom cap 104 may be employed and the invention is not limited to the use of tabs. Moreover, the movement of the transport member 124 with respect to the remainder of the bottom cap 104 need not be rotational. To the extent different known mechanisms are employed, which is contemplated by the present invention, the type of movement of the transport mechanism 124 may vary.

To further facilitate movement, the bottom cap 104 may also include a biasing member 138 adapted to bias the tab 126 away from the tab 136. The biasing member 138 may be a spring, such as the illustrated torsion spring, or any other suitable structure for biasing the tab 126 away from the tab 136. Although a torsion spring is used as a biasing member 138 in the presently preferred embodiment, it should be understood that any suitable biasing mechanism may be used and the invention is not limited.

The purpose of the movement of the transport member 124 with respect to the remainder of the bottom cap 104 is to transport a pill that passes through the upper opening 114 to the bottom opening 130 so that the pill may be dispensed. Preferably, the biasing member 138 forces the tab 126 away from the tab 136. Thus, when the tab 126 is fully biased away from tab 136 (the first tab position), the pill receiving portion 134 of the transport member 124 is in a first pill position aligned with the upper opening 114 of the upper bottom surface 112 as shown in FIG. 2B. A pill passing through the upper opening is then received by the pill receiving portion 134 of the transport member 124. Movement of the tab 126 toward tab 136 (the second tab position) causes the pill receiving portion 134 to move from the first pill position aligned with the upper opening 114 to a second pill receiving position aligned with the lower opening 130, which in turn dispenses the pill via the lower opening 130. In this manner, movement of the tab 126 from a first tab position to a second tab position causes movement of the pill receiving portion 134 from the first pill position to the second pill position.

Figure 2D:
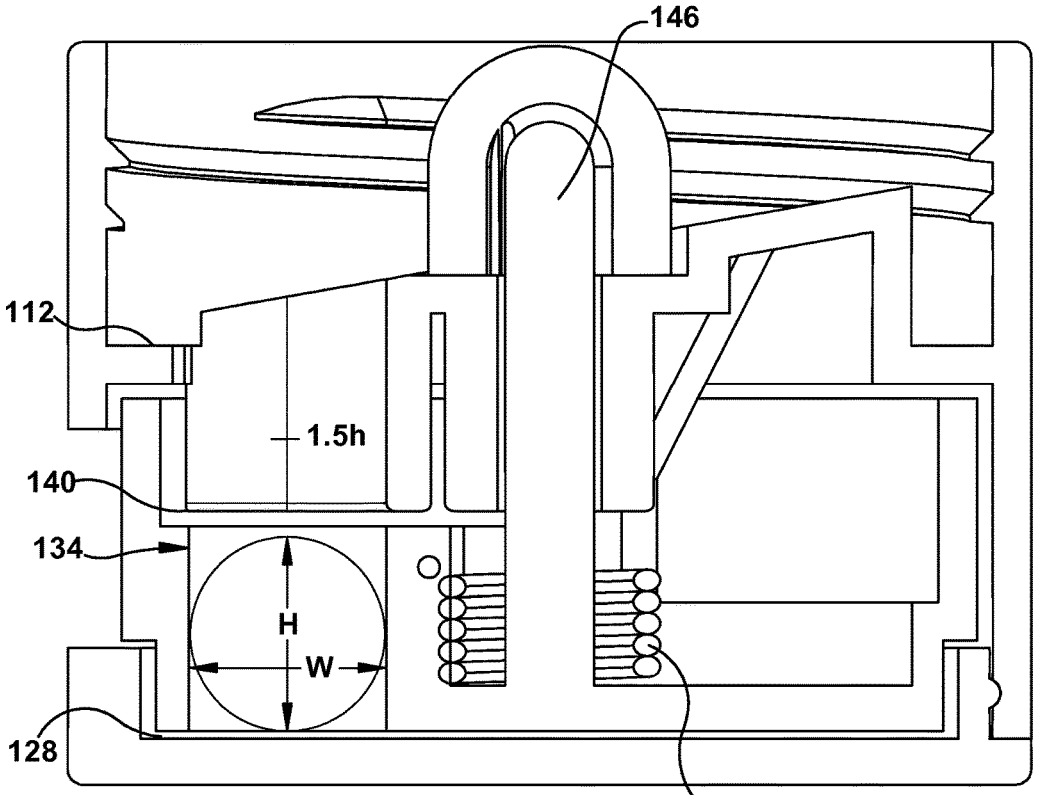
FIG. 2D is a cross sectional perspective view of the bottom cap of the pill dispenser of FIG. 1.

As shown in FIG. 2D, the lower bottom surface 128 is spaced from the end 140 of the upper bottom opening 114 by a distance greater than the height dimension (H) and greater than the width dimension (W) of the pill. Preferably, the lower bottom surface 128 is spaced from the end 140 of the upper bottom opening 114 by a distance of greater than H and less than one and one half times the dimension H. Such spacing helps prevent more than one pill from entering the pill receiving portion 134 of the transport member 124 at a time.

Figure 2E:
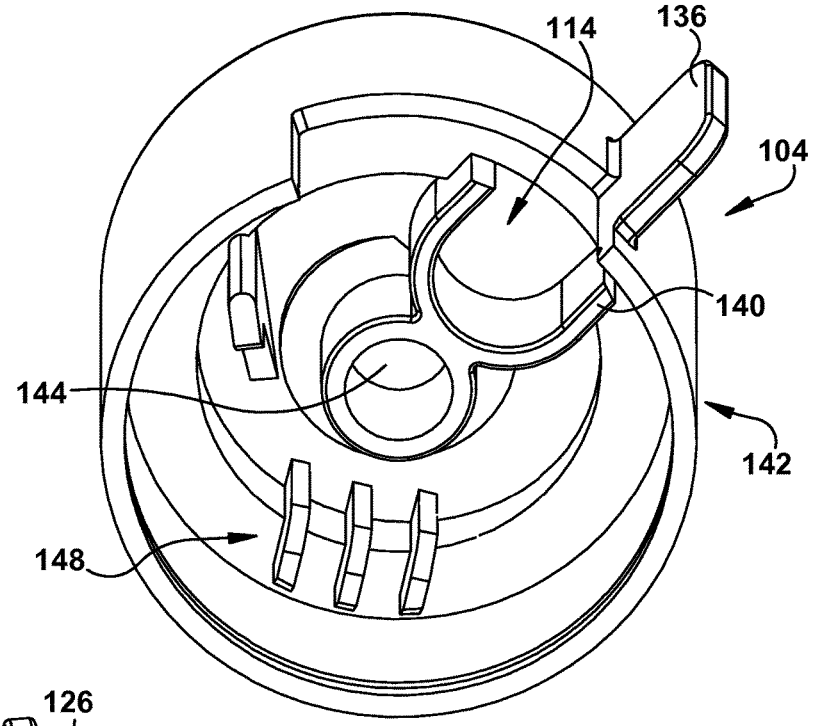
FIG. 2E is a bottom perspective view of a portion of the bottom cap of the pill dispenser of FIG. 1.

Turning next to FIG. 2E, the underside of the top portion 142 of the bottom cap 104 is illustrated. In addition to the elements discussed above, the top portion 142 of the bottom cap 104 includes a central hole 144 sized to receive a central axis member 146 of the transport member 124. The top portion 142 of the bottom cap 104 also includes a catch 148 that receives the portion of the stand that engages the slot 132. In one embodiment, the catch is formed by multiple elements protruding from the underside of the top portion 142 of the bottom cap 104, which assert lateral force on the portion of the stand that engages the slot.

Referring again to FIG. 2B, the bottom cap 104 may also include a sweeper 150 above the ramp 120. The sweeper 150 may function to move pills toward the upper bottom opening 114 and help prevent pills from jamming or sticking together. Preferably, the sweeper 150 is a bar or plate that rotates about a central axis of the bottom cap 104 and has a length (L) that is greater than the difference between the radius (R) of the bottom cap 104 and the diameter (D) of a pill. In this manner, there is insufficient space for a pill to pass between the end of the sweeper 150 and the side of the bottom cap 104. Accordingly, the sweeper 150 may function to facilitate single file transport of pills toward the upper bottom opening 114.

Figure 3A:
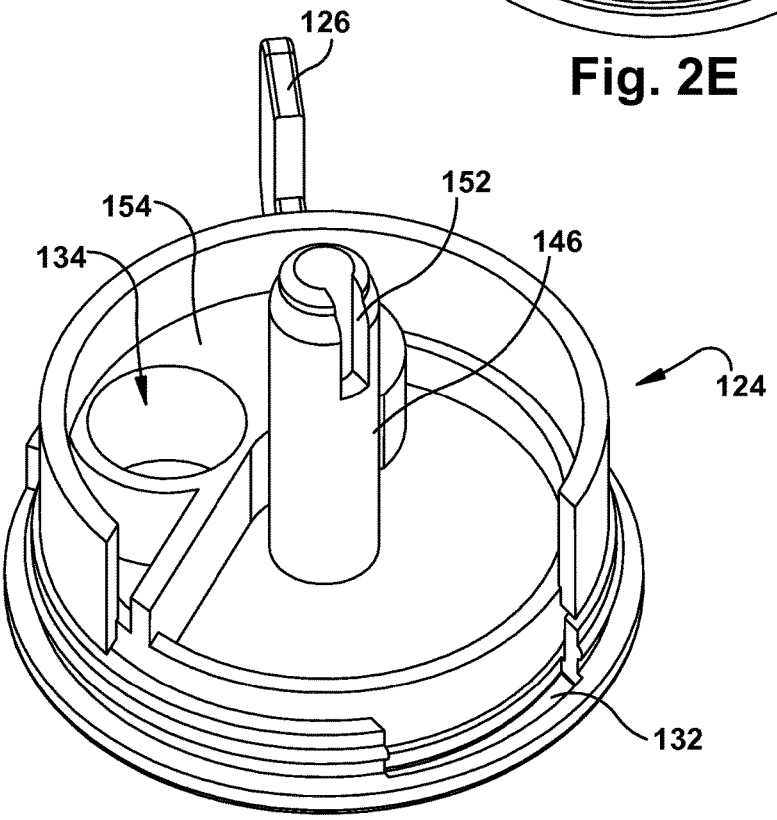
FIG. 3A is a top perspective view of the transport member of the bottom cap of the pill dispenser of FIG. 1.
Figure 3B:
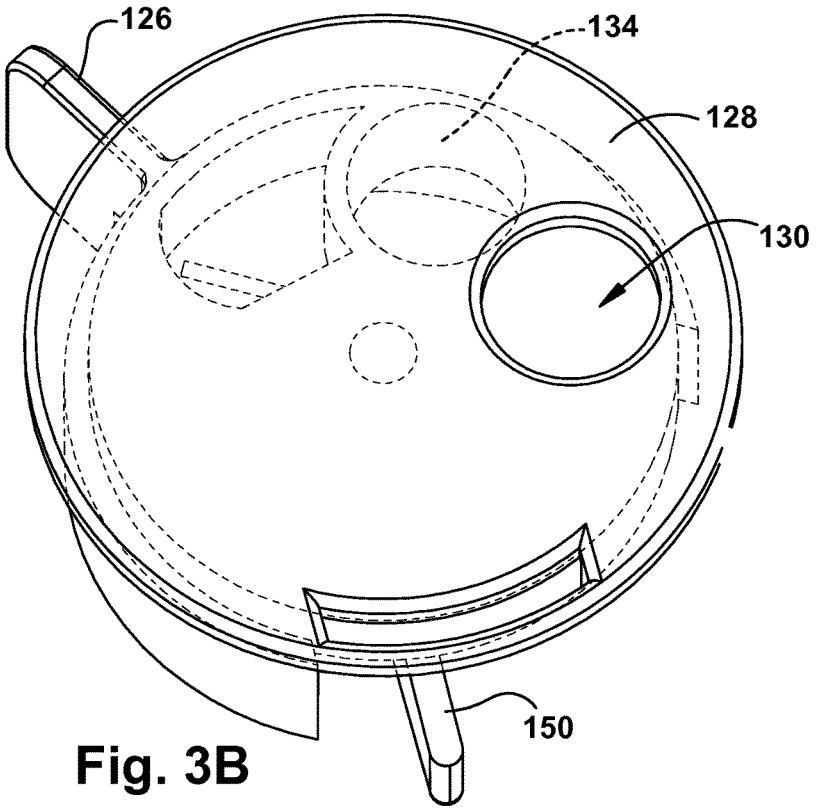
FIG. 3B is a bottom perspective view of the transport member and the lower bottom surface of the bottom cap of the pill dispenser of FIG. 1.

Turning next to FIGS. 3A-B, the transport member 124 is shown in greater detail. As can be seen, the slot 132 passes through the transport member 124 and lower bottom surface 128. In addition, the central axis member 146 of the transport member 124 may include a notch 152 for engaging the sweeper 150. The notch 152 may function to rotationally fix the central axis member 146 and the sweeper 150. As a result, movement of the transport member 124, such as rotational movement caused by moving tab 126 toward tab 136, causes movement of the sweeper 150. Thus, when a user pinches the tabs 126 and 136, the sweeper 150 simultaneously rotates. To the extent the sweeper 150 and the transport member 124 are rotationally fixed, rotation of the transport member 124 with respect the remainder of the bottom cap 104 may cause rotation of the sweeper 150 with respect to the remainder of the bottom cap 104 such that the transport member 124 and the sweeper 150 have the same amount of rotation with respect to the remainder of the bottom cap 104.

The pill receiving portion 134 preferably is limited in size to receive only a single pill, but sufficiently large to transport a single pill from the first pill position to the second pill position. Accordingly, the pill receiving portion 134 may have a height that is greater than the radius of the pill so as to avoid elevating the pill during transport. In addition, adjacent the pill receiving portion may be an elevated portion 154. Thus, when the transport member 124 is rotated such that the pill is no longer in the first pill position, the elevated portion 154 replaces the pill receiving portion beneath the upper opening 114 such that additional pills are prevented from passing through the upper opening 114 until the transport member 124 is rotated back (such as by the biasing member) and the pill receiving portion 134 is once again aligned with the upper opening 114.

Figure 4:
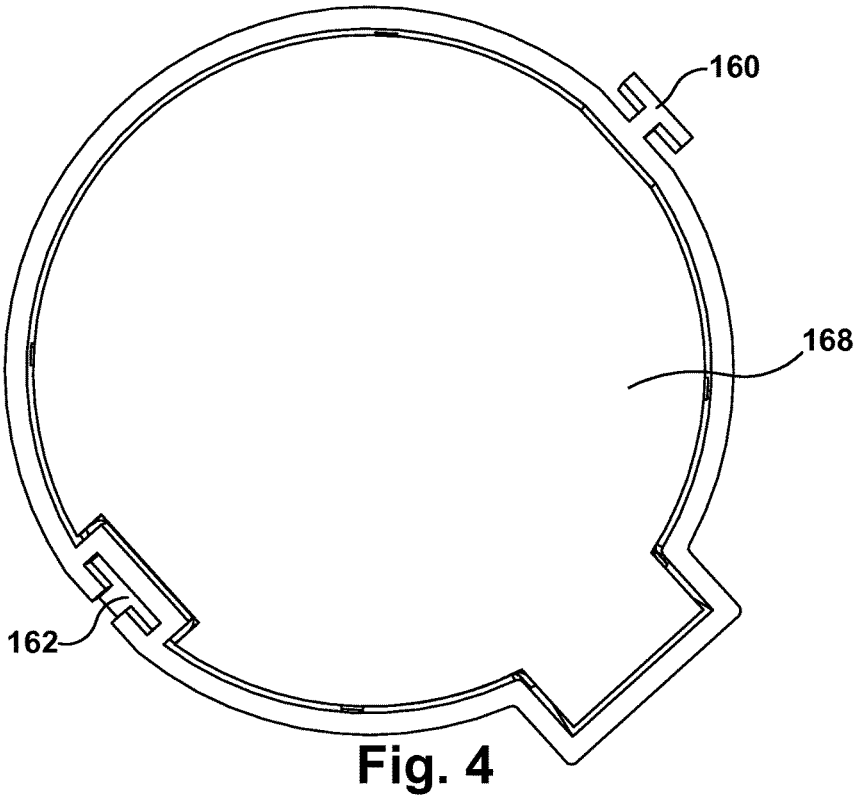
FIG. 4 is a bottom view of the pill dispenser of FIG. 1.

Referring again to FIG. 1, and additionally to FIG. 4, views of the stand 106 is depicted. The stand 106 has a base 156 and a top portion 158, the top of which may engage the slot 132 and catch 148 of the bottom cap 104 such that the bottom cap 104 is spaced from the base 106. In addition, the base 156 may have a recess 164 under the bottom cap 104.

Figure 5:
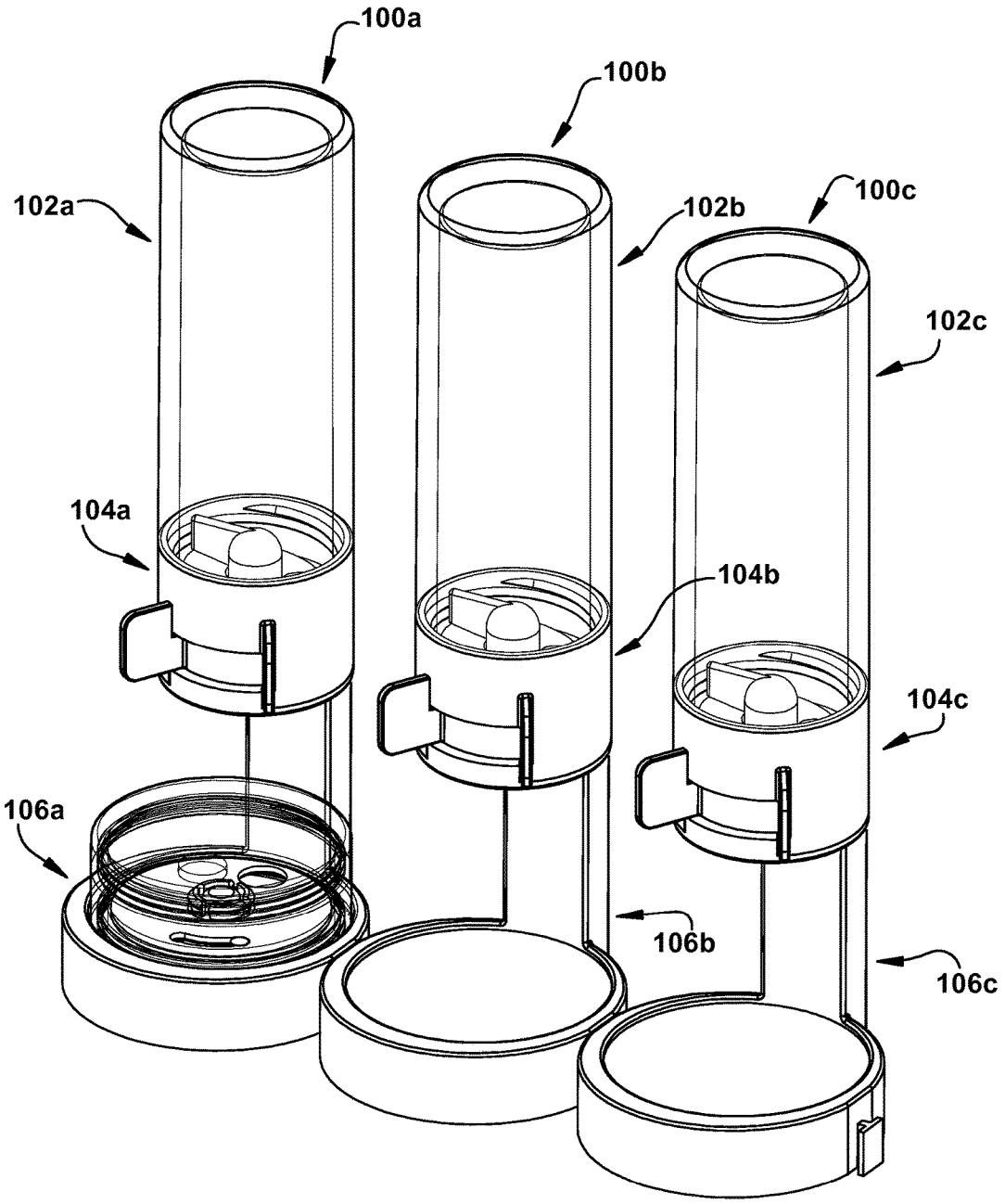
FIG. 5 is a perspective view of multiple pill dispensers connected together.

Preferably, the base 156 is adapted to engage a base of an adjacent stand. In one embodiment, the base 156 includes a tongue 160 on one side and a groove 162 on an opposing side so that a tongue of one base aligns with a groove of an adjacent base. The tongue and groove are slidably engagable. Those of skill in the art will recognize that adjacent bases may be slidably engageable, rotatably engageable and/or snapably engageable by employing any number of well-known engagement mechanisms. FIG. 5 illustrates multiple pill dispensers connected via the tongue and groove mechanism illustrated in FIG. 4.

Those skilled in the art will recognize that the particular shape of the stand 106 is not limiting. In one embodiment, the base 156 is generally circular, and the top portion 158 has a generally flat rear surface 166 to facilitate mounting the pill dispenser on a vertical surface, such as a wall. In addition, in one embodiment, the base 156 of the stand is weighted, such as with a permanent or removable weight, to lower the center of gravity of the pill dispenser and provide tipping resistance. In addition, the bottom surface 168 of the base 156 may be a high friction material to provide sliding resistance. Such materials are well-known in the art.

Figure 6:
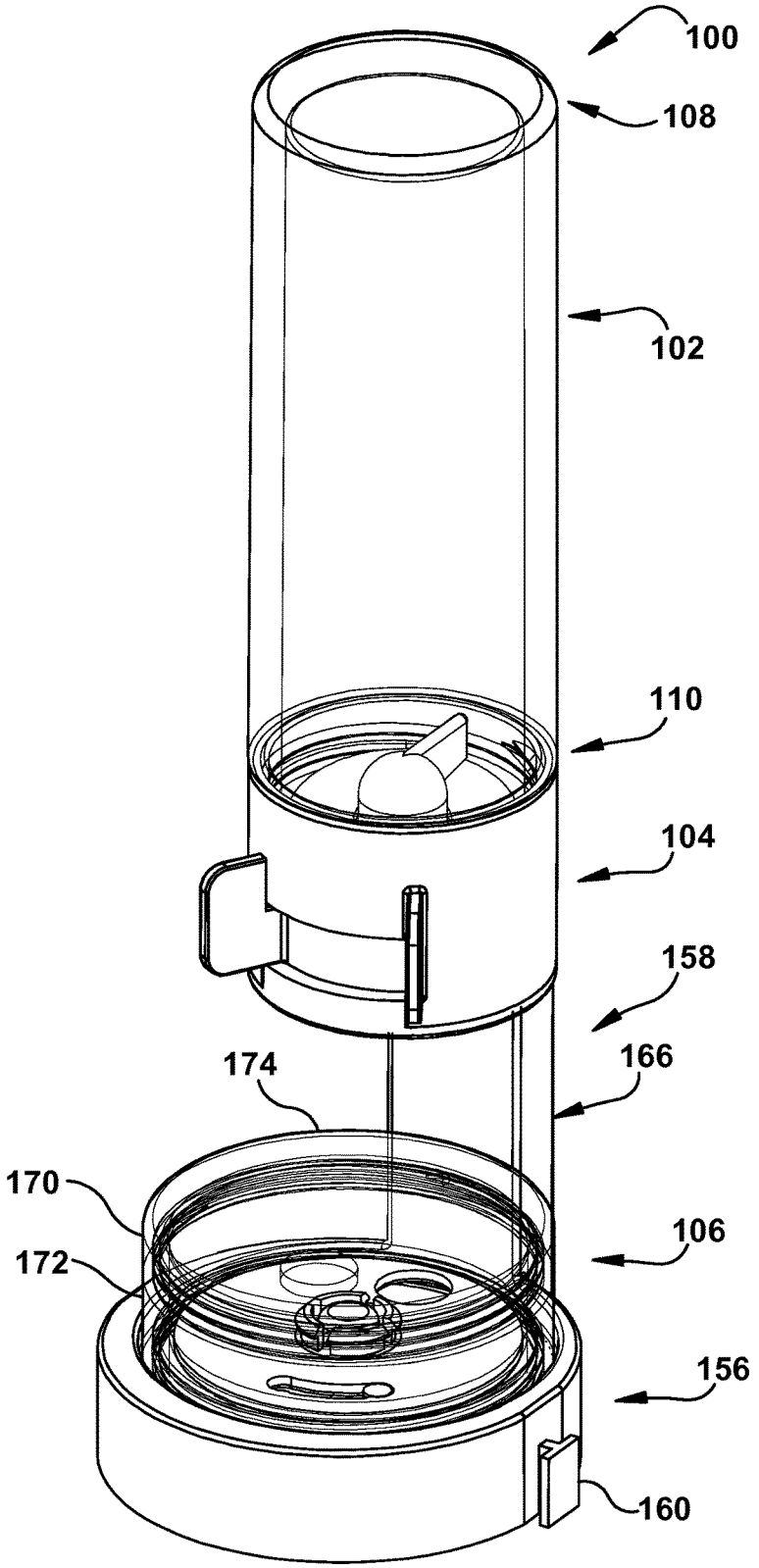
FIG. 6 is a perspective view of the pill dispenser of FIG. 1 and a pill container.
Figure 7A:
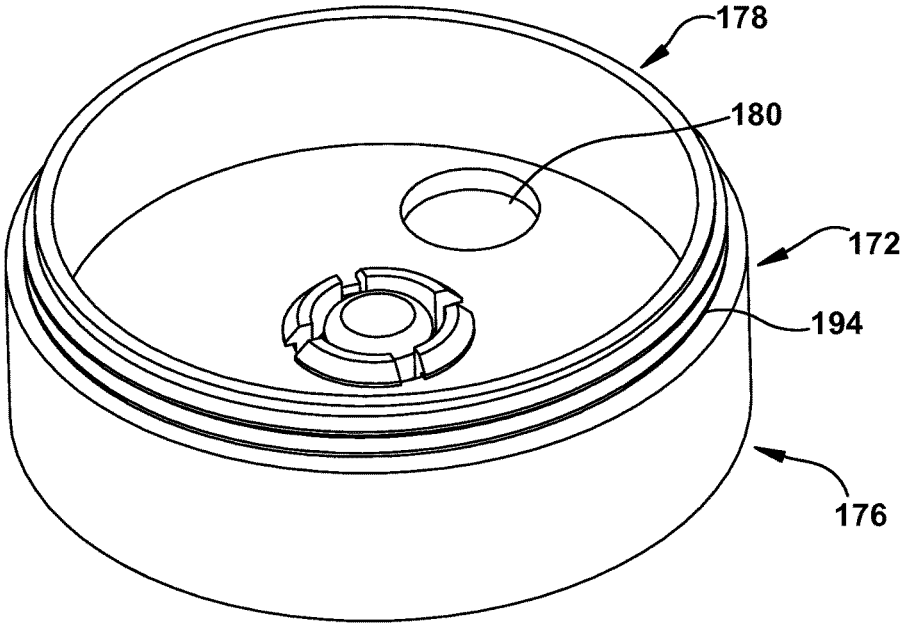
FIG. 7A is a perspective view of the body of the pill container of FIG. 6.
Figure 7B:
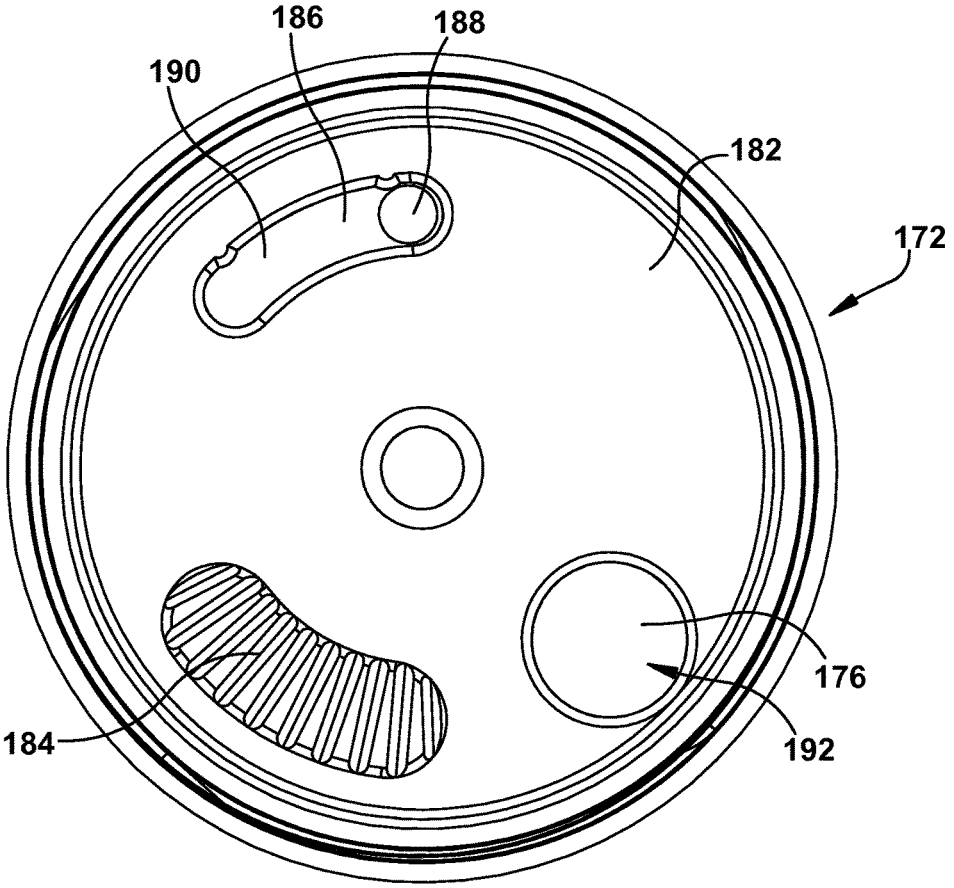
FIG. 7B is a bottom view of the body of the pill container of FIG. 6.
Figure 8:
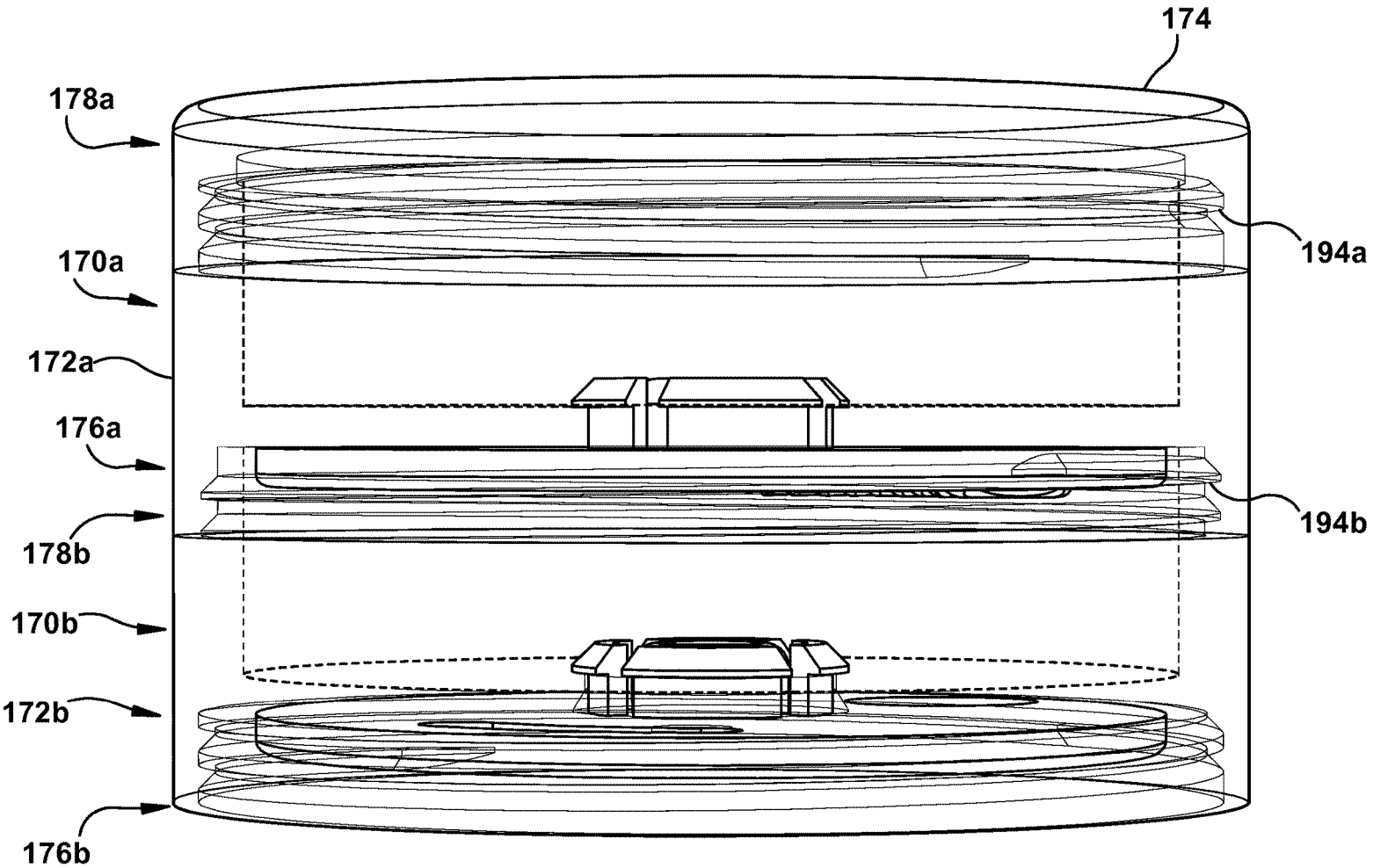
FIG. 8 is a front view of multiple pill containers connected together.

Turning next to FIGS. 6-8, the pill dispenser may also include a pill container 170 for storing multiple pills. The pill container 170 may be adapted to be positioned on the base 156 under the bottom cap 104. In addition, the recess 164 may be sized to accommodate a pill container such as that depicted in FIGS. 6-8. Thus, when the pill container 170 is positioned on the base 156 under the bottom cap 104, the relative position of the pill container 170 with respect to the bottom cap 104 is maintained by the recess 164 in the base 156.

The pill container 170 may include a pill container housing 172 and a top cap 174. Preferably, the pill container housing 172 has a closed bottom end 176 and an open top end 178. At least one of the top cap 174 or the closed bottom end 176 includes a closable dispensing opening 180 through which pills can be dispensed. Although the dispensing opening 180 is depicted in the bottom of the pill container 172, it should be understood that it could instead be located in the cap 174, or even a side of the pill container.

As shown in FIGS. 7A-B, the closed bottom end 176 includes a dispensing opening 180. Beneath the dispensing opening 180 is a rotatable mechanism 182 for providing access to the dispensing opening 180. The rotatable mechanism 182 includes a grip 184 to facilitate a user's attempt to rotate the mechanism, which is generally disc shaped in the embodiment illustrated in FIGS. 7A-B. The grip 184 may have ridges or other structures for increasing friction as will be understood by those of skill in the art. The rotatable mechanism also includes a rotation control 186 to control and/or limit the amount of rotation of the rotatable mechanism 182. In one embodiment, the rotation control 186 is a cam 188 and groove 190 structure.

The rotatable mechanism further includes an opening 192 that, when aligned with the dispensing opening 180, permits a pill to be dispensed. When the rotatable mechanism 182 is in a closed position, the opening 192 is not aligned with the dispensing opening 180. Rotating the rotatable mechanism to an open state brings the opening 192 into alignment with the dispensing opening. Although one embodiment of a rotatable mechanism for closing the dispensing opening 180 is described and illustrated, it should be understood by those of skill in the art that other types of rotatable mechanisms may be used. Moreover, any type of closure mechanism, such as sliding, hinged or snapping mechanisms, could alternatively be used.

The pill container housing 172 is adapted to engage, preferably removably engage, the top cap 174. In one embodiment, the pill container housing 172 includes threads 194 for engaging the top cap 174. Those of skill in the art will recognize that the pill container housing 172 and the top cap 174 may be slidably engageable, rotatably engageable and/or snapably engageable by employing any number of well-known engagement mechanisms.

In one embodiment, the closed bottom end 176 of the pill container 172 housing also includes an engagement mechanism, such as threads in the case of a threaded engagement with the top cap 174. Preferably, the engagement mechanism for the top cap 174 matches the engagement mechanism of the closed bottom end 176 so that two pill containers 172 may be engaged. Thus, in addition to being adapted to engage the top cap 174, the top end 178 of first pill container 172 may also be adapted to engage the bottom end 176 of a second pill container 172. Such engagement is illustrated in FIG. 8.

The preferred embodiments of the present disclosure are described above with reference to the drawings. Many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

Particular embodiments of the present disclosure have been disclosed herein. Those skilled in the art will readily recognize that the present disclosure is applicable in other environments. In practice, there exist many embodiments and implementations. The appended claims are by no means intended to limit the scope of the present disclosure to the above particular embodiments.

Although a particular preferred embodiment or embodiments have been shown and the present disclosure has been described, it should be understood that equivalent modifications and variants are conceivable to those skilled in the art in reading and understanding the description and drawings. Especially for various functions executed by the above elements (portions, assemblies, apparatus, and compositions, etc.), except otherwise specified, it is desirable that the terms (including the reference to "device") describing these elements correspond to any element executing particular functions of these elements (i.e. functional equivalents), even though the element is different from that executing the function of an exemplary embodiment or embodiments illustrated in the present disclosure with respect to structure. Furthermore, although a particular feature of the present disclosure is described with respect to only one or more of the illustrated embodiments, such a feature may be combined with one or more other features of other embodiments as desired and in consideration of advantageous aspects of any given or particular application.

In addition, any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, it is intended that values such as 15 to 85, 22 to 68, 43 to 51, 30 to 32 and the like, are expressly enumerated in this specification. These are only examples of what is specifically intended and all possible combinations of numerical values between the lowest value and the highest value enumerated are to be considered to be expressly stated in this application in a similar manner.

What is claimed is:

1. A pill dispenser adapted to dispense pills comprising:
a housing having a top end and an open bottom end; and
a bottom cap adapted to engage the open bottom end of the housing, the bottom cap comprising:
an upper bottom surface having an upper opening sufficiently large to receive a pill such that a pill may traverse the upper bottom surface,
a ramp formed by the upper bottom surface and adapted to direct pills toward the upper opening,
a sweeper above the upper bottom surface, wherein the sweeper is moveable independent of the ramp;
a lower bottom surface spaced from the upper bottom surface by a distance greater than a height or width dimension of the pill, the lower bottom surface having a lower opening sufficiently large to receive a pill, wherein the lower opening is not vertically aligned with the upper opening, and
a transport member having a pill receiving portion, between the upper opening and the lower bottom surface, that is moveable from a first pill position aligned with the upper opening to a second pill position aligned with the lower opening,
wherein the sweeper extends toward a side of the bottom cap such that a distance between the sweeper and the side of the bottom cap is less than a smallest dimension of a pill to be dispensed.

2. The pill dispenser of claim 1, wherein the pill receiving portion of the transport member is located in a step having an elevated portion, wherein the pill receiving portion is adjacent to the elevated portion such that the elevated portion is aligned with the upper opening when the pill receiving portion is in the second pill position.

3. The pill dispenser of claim 1, wherein the pill receiving portion is movable in a first direction from the first pill position to the second pill position and movable from the second pill position to the first pill position in a second direction opposite the first direction, and
wherein the pill dispenser further comprises a biasing member adapted to bias the transport member in the second direction toward the first pill position.

4. The pill dispenser of claim 1 wherein the transport member comprises a tab extending outwardly from a side of the bottom cap, wherein movement of the tab from a first tab position to a second tab position causes movement of the pill receiving portion from the first pill position to the second pill position.

5. The pill dispenser of claim 4 wherein the tab is biased toward the first tab position.

6. The pill dispenser of claim 4, wherein the bottom cap comprises a second tab extending outwardly from a side of the bottom cap, and wherein the transport member tab moves toward the second tab as the transport member tab moves from a first tab position to a second tab position.

7. The pill dispenser of claim 1, wherein the pill receiving portion is movable in a first direction from the first pill position to the second pill position and movable from the second pill position to the first pill position in a second direction opposite the first direction.

8. The pill dispenser of claim 1 wherein movement of the transport member causes movement of the sweeper.

9. The pill dispenser of claim 1, wherein the ramp is arcuate in shape.

10. The pill dispenser of claim 1 wherein the lower bottom surface is spaced from an end of the upper bottom opening by a distance of greater than the height dimension of the pill and less than one and one half times the height dimension of the pill.

11. The pill dispenser of claim 1 further comprising a stand having a base and a top portion that engages the bottom cap such that the bottom cap is spaced from the base.

12. The pill dispenser of claim 11 wherein the base is adapted to slidably or snapably engage an adjacent base of an adjacent stand.

13. The pill dispenser of claim 11 further comprising a second pill dispenser as set forth in claim 10, wherein the pill dispenser and the second pill dispenser are engaged.

14. The pill dispenser of claim 11 further comprising a pill container for storing multiple pills, wherein the pill container is adapted to be positioned on the base under the bottom cap.

15. The pill dispenser of claim 14, wherein a top end of the pill container is adapted for fixed engagement with a bottom end of another container.

16. A system for dispensing and storing pills comprising:
a first pill dispenser and a second pill dispenser, each of the first and second pill dispensers as set forth in claim 1;
a stand assembly engaging each of the first and second pill dispensers; and
at least one pill container adapted to store pills.

17. The system of claim 16, wherein the stand assembly comprises a first part connected to a second part, the first part engaging the first pill dispenser and the second part engaging the second pill dispenser.

18. A pill dispenser adapted to dispense pills comprising:
a housing having a top end and an open bottom end; and
a bottom cap adapted to engage the open bottom end of the housing, the bottom cap comprising:
an upper bottom surface having an upper opening sufficiently large to receive a pill such that a pill may traverse the upper bottom surface,
a ramp formed by the upper bottom surface and adapted to direct pills toward the upper opening,
a sweeper above the upper bottom surface,
a lower bottom surface spaced from the upper bottom surface by a distance greater than a height or width dimension of the pill, the lower bottom surface having a lower opening sufficiently large to receive a pill, wherein the lower opening is not vertically aligned with the upper opening, and
a transport member adapted to transport a pill from a first pill position to a second pill position, the transport member having a step with an elevated portion adjacent a pill receiving portion that is between the upper opening and the lower bottom surface,
wherein the pill receiving portion is aligned with the upper opening when in the first pill position, and
wherein the pill receiving portion is aligned with the lower opening and the elevated portion prevents pills from traversing the upper opening when in the second pill position.

19. A pill dispenser adapted to dispense pills comprising:
a generally cylindrical housing having a top end and an open bottom end; and
a bottom cap adapted to engage the open bottom end of the housing, the bottom cap comprising:

an upper bottom surface having an upper opening sufficiently large to receive a pill such that a pill may traverse the upper bottom surface, a sweeper above the upper bottom surface, an arcuate ramp formed by the upper bottom surface and encircling a central axis of the bottom cap and vertically located between the sweeper and the upper bottom surface, a lower bottom surface spaced from the upper bottom surface by a distance greater than a height or width dimension of the pill, the lower bottom surface having a lower opening sufficiently large to receive a pill, wherein the lower opening is not vertically aligned with the upper opening, and a transport member adapted to transport a pill from a first pill position to a second pill position, the transport member having a step with an elevated portion adjacent a pill receiving portion that is between the upper opening and the lower bottom surface, wherein the pill receiving portion is aligned with the upper opening when in the first pill position, and wherein the pill receiving portion is aligned with the lower opening and the elevated portion prevents pills from traversing the upper opening when in the second pill position.

20. The pill dispenser of claim 19, wherein the sweeper extends toward a side of the bottom cap such that a distance between the sweeper and the side of the bottom cap is less than a smallest dimension of a pill to be dispensed, and wherein the pill receiving portion is movable in a first direction from the first pill position to the second pill position and movable from the second pill position to the first pill position in a second direction opposite the first direction.

* * * * *